US007896347B1

(12) United States Patent
Vail

(10) Patent No.: US 7,896,347 B1
(45) Date of Patent: Mar. 1, 2011

(54) BOARD GAME

(76) Inventor: Norman W. Vail, Stratford (CA)

( * ) Notice: Subject to any disclaimer, the term of this patent is extended or adjusted under 35 U.S.C. 154(b) by 0 days.

(21) Appl. No.: 12/483,131

(22) Filed: Jun. 11, 2009

(51) Int. Cl.
*A63F 3/00* (2006.01)

(52) U.S. Cl. ..... 273/236; 273/253; D21/362

(58) Field of Classification Search ..... 273/236, 273/250, 251, 252, 253; D21/362
See application file for complete search history.

(56) References Cited

U.S. PATENT DOCUMENTS

| | | | | | |
|---|---|---|---|---|---|
| 1,406,691 | A | * | 2/1922 | Sewell | 273/249 |
| 1,615,982 | A | * | 2/1927 | Jewett | 273/245 |
| 3,559,995 | A | * | 2/1971 | Steadman | 273/141 A |
| 3,652,092 | A | * | 3/1972 | Boyer et al. | 273/243 |
| 3,785,654 | A | * | 1/1974 | Chambers | 273/249 |
| 3,796,432 | A | * | 3/1974 | Beakley | 273/243 |
| 4,359,226 | A | * | 11/1982 | Neff | 273/243 |
| 4,560,169 | A | * | 12/1985 | North | 273/242 |
| 4,778,186 | A | * | 10/1988 | Dudley | 273/243 |
| 4,779,870 | A | * | 10/1988 | Nichols | 273/161 |
| 5,071,133 | A | | 12/1991 | Smith | |
| 5,092,606 | A | | 3/1992 | Miller | |
| 5,152,535 | A | | 10/1992 | Roberts | |
| 5,295,834 | A | | 3/1994 | Saunders | |
| 5,377,991 | A | | 1/1995 | Olsen | |
| 5,529,308 | A | | 6/1996 | Masakayan | |
| 5,816,819 | A | * | 10/1998 | Rockburn | 434/106 |
| 6,234,481 | B1 | * | 5/2001 | Robertson | 273/243 |
| D525,663 | S | | 7/2006 | Ambrose | |

* cited by examiner

*Primary Examiner* — Vishu K. Mendiratta

(57) ABSTRACT

A board game for between two and seven players comprising a board comprising a large outer circle disposed thereon; a center circle disposed in the large circle; fourteen stripes each extending radially from the center circle to the large outer circle, each stripe labelled with a deadly sin or a chakra of enlightenment; twenty one dividing lines extending radially from the center circle to the large outer circle; and seven concentric circles extending outwardly from the center circle to the large outer circle, wherein one or more boxes are labeled with a command; a plurality of playing pieces; a first wheel for determining how many boxes a player can move a playing piece; a second wheel for determining how many playing pieces a player can move; and a plurality of cards that display a phrase.

4 Claims, 10 Drawing Sheets

FULL VIEW FOR PURPOSES OF ILLUSTRATION
EXPLODED VIEWS OF LETTERINGS IN SUBSEQUENT VIEWS

FULL VIEW FOR PURPOSES OF ILLUSTRATION
EXPLODED VIEWS OF LETTERINGS IN SUBSEQUENT VIEWS

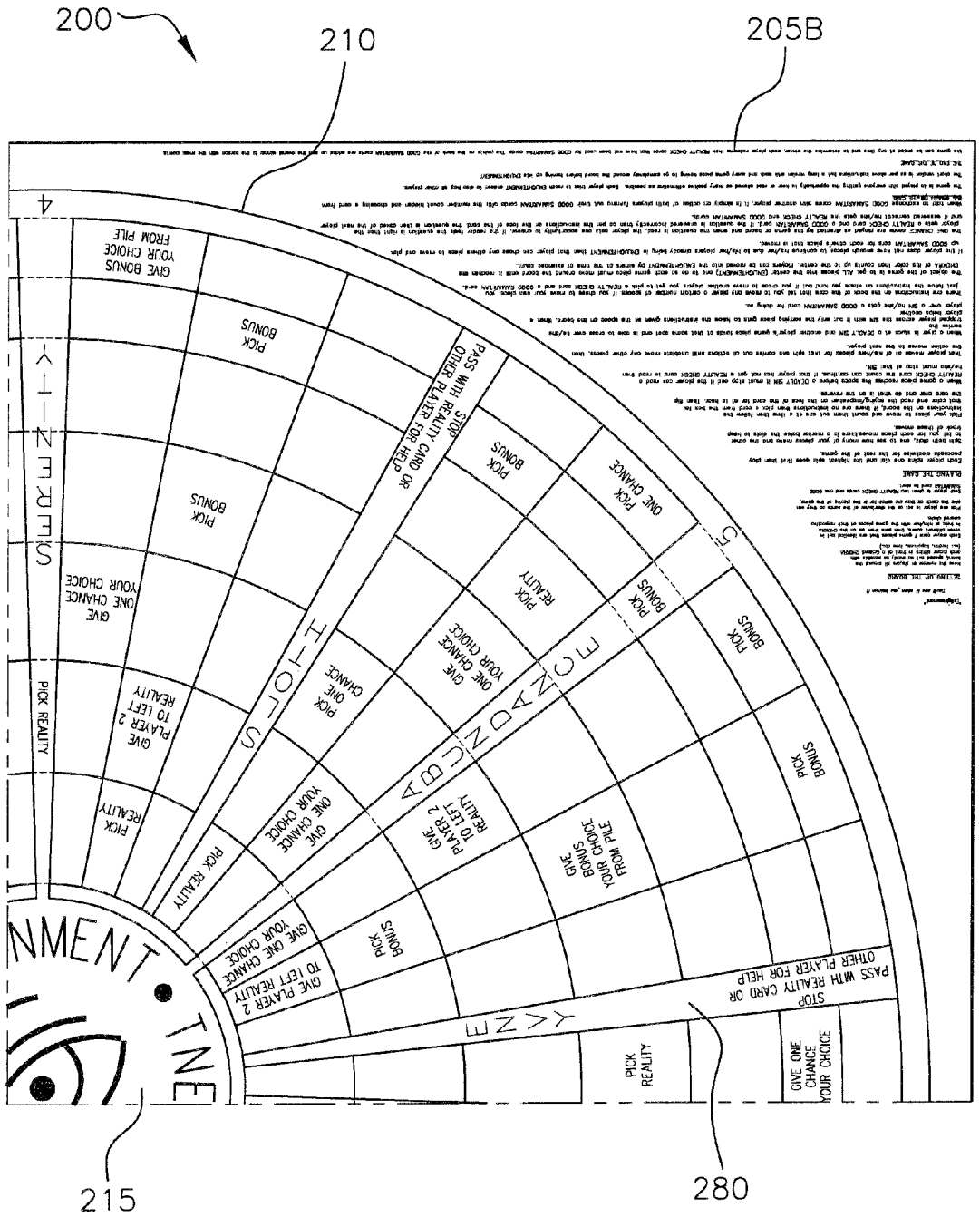
200
210
205B
215
280
PICK REALITY
GIVE ONE CHANCE YOUR CHOICE
STOP PASS WITH REALITY CARD OR OTHER PLAYER FOR HELP
PICK BONUS
GIVE SMART BONUS YOUR CHOICE FROM PILE
GIVE PLAYER 2 TO LEFT REALITY
GIVE ONE CHANCE YOUR CHOICE
PICK REALITY
PICK BONUS
GIVE ONE CHANCE
PICK REALITY
PICK BONUS
GIVE ONE CHANCE YOUR CHOICE
PICK BONUS
PICK REALITY
GIVE PLAYER 2 TO LEFT REALITY
GIVE ONE CHANCE YOUR CHOICE
PICK BONUS
STOP PASS WITH REALITY CARD OR OTHER PLAYER FOR HELP
PICK BONUS
GIVE BONUS YOUR CHOICE FROM PILE
PICK REALITY
GIVE ONE CHANCE YOUR CHOICE
PICK BONUS
PICK REALITY
GIVE PLAYER 2 TO LEFT REALITY
PICK REALITY
PICK BONUS
GIVE ONE CHANCE YOUR CHOICE
PICK BONUS
PICK REALITY "Enlightenment"

*You'll see it when you believe it*

SETTING UP THE BOARD

Have the number of players sit around the board, spaced out as evenly as possible with each player sitting in front of a Colored CHOKRA (i.e.: Health, happiness, love etc.)

Each player gets 7 game pieces that are identical but in seven different colors, then sets them up on the CHOKRA in front of him/her with the game pieces at their respective colored circle.

Pick one player to act as the distributor of the cards so they can give the cards as they are called for in the playing of the game.

Each player is given two REALITY CHECK cards and one GOOD SAMARITAN card to start.

PLAYING THE GAME

Each player spins one dial and the highest spin goes first then play proceeds clockwise for the rest of the game.

Spin both dials, one to see how many of your pieces move and the other to tell you far each piece moves,there is a marker below the dials to keep track of these moves.

Pick your piece to move and count them out one at a time then follow the instructions on the board, if there are no instructions then pick a card from the box for that color and read the saying/inspiration on the face of the card for all to hear. Then flip the card over and do what is on the reverse.

When a game piece reaches the space before a DEADLY SIN it must stop and if the player can read a REALITY CHECK card the count can continue. If that player has not got a REALITY CHECK card to read then he/she must stop at that SIN.

That player moves all of his/hers pieces for that spin and carries out all actions until unable to move any other pieces, then the action moves to the next player.

205B

200

FIG. 2F-1

205B

200

When a player is stuck at a DEADLY SIN and another player's game piece lands at that same spot and is able to cross over he/she carries the
trapped player across the SIN with it but only the carrying piece gets to follow the instructions given on the space on the board. When a player helps another
player over a SIN he/she gets a GOOD SAMARITAN card for doing so.

There are instructions on the back of the cars that tell you to move any player a certain number of spaces. If you chose to move your own piece, you just follow the instructions on where you land but if you chose to move another players you get to pick a REALITY CHECK card and a GOOD SAMARITAN card.

The object of the game is to get ALL pieces into the center (ENLIGHTENMENT) and to do so each game piece must move around the board until it reaches the CHOKRA of it's color then counts up to the center. Players can be moved into the ENLIGHTENMENT by others at the time of extended count.

If the player does not have enough pieces to continue his/her due to his/her players already being in ENLIGHTENMENT then that player can chose any others piece to move and pick
up GOOD SAMARITAN cars for each other's piece that is moved.

The ONE CHANCE cards are played as directed by the game or board and when the question is read, the player gets one opportunity to answer. If the reader feels the question is right then the
player gets a REALTY CHECK card and a GOOD SAMARITAN card. If the question is answered incorrectly then as per the instructions
on the face of the card, the question is then asked of the next player and if answered correctly he/she gets the REALTY CHECK and GOOD SAMARITAN cards.

When told to exchange GOOD SAMARITAN cards with another player, it is simply an action of both players fanning out their GOOD SAMARITAN cards with the number count hidden and choosing a card from the others pile.

THE OBJECT OF THE GAME

The game is to played with everyone getting the opportunity to hear or read allowed as many positive affirmations as possible. Each player tries to reach ENLIGHTENMENT and to also help all other players.

The short version is as per above instructions but a long version with each and every game piece having to go completely around the board before turning up into ENLIGHTENMENT.

THE END OF THE GAME

The game can be ended at any time and to determine the winner, each player redeems their REALITY CHECK cards
that have not been used for GOOD SAMARITAN cards. The points on the back of the GOOD SAMARITAN cards are added up and the overall winner is the person with the most points.

FIG. 2F-2

BOARD GAME

FIELD OF THE INVENTION

The present invention is directed to a board game, more particularly to a board game illustrating seven chakras of enlightenment and seven deadly sins. The object of the game is to earn the most points.

BACKGROUND OF THE INVENTION

The present invention features a board game for entertainment and/or educational purposes. The game may further incorporate spiritual learning. For example, the game illustrates the seven chakras of enlightenment and the seven deadly sins. The object of the game is to earn the most points.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIGS. 2A-2E are top exploded views of various regions of the board of the board game of the present invention. In particular, FIG. 2E recites the following:

7 Deadly Sins

LUST: Intense desire or craving for self gratification

AVARICE: Insatiable greed for riches, miserly desire to gain and hoard wealth

SLOTH: Spiritual and/or actual apathy or laziness

ENVY: Desire or wishes for another's superior duality or possession

ANGER: An emotional state that may range from minor irritation to intense rage

Figure 1:
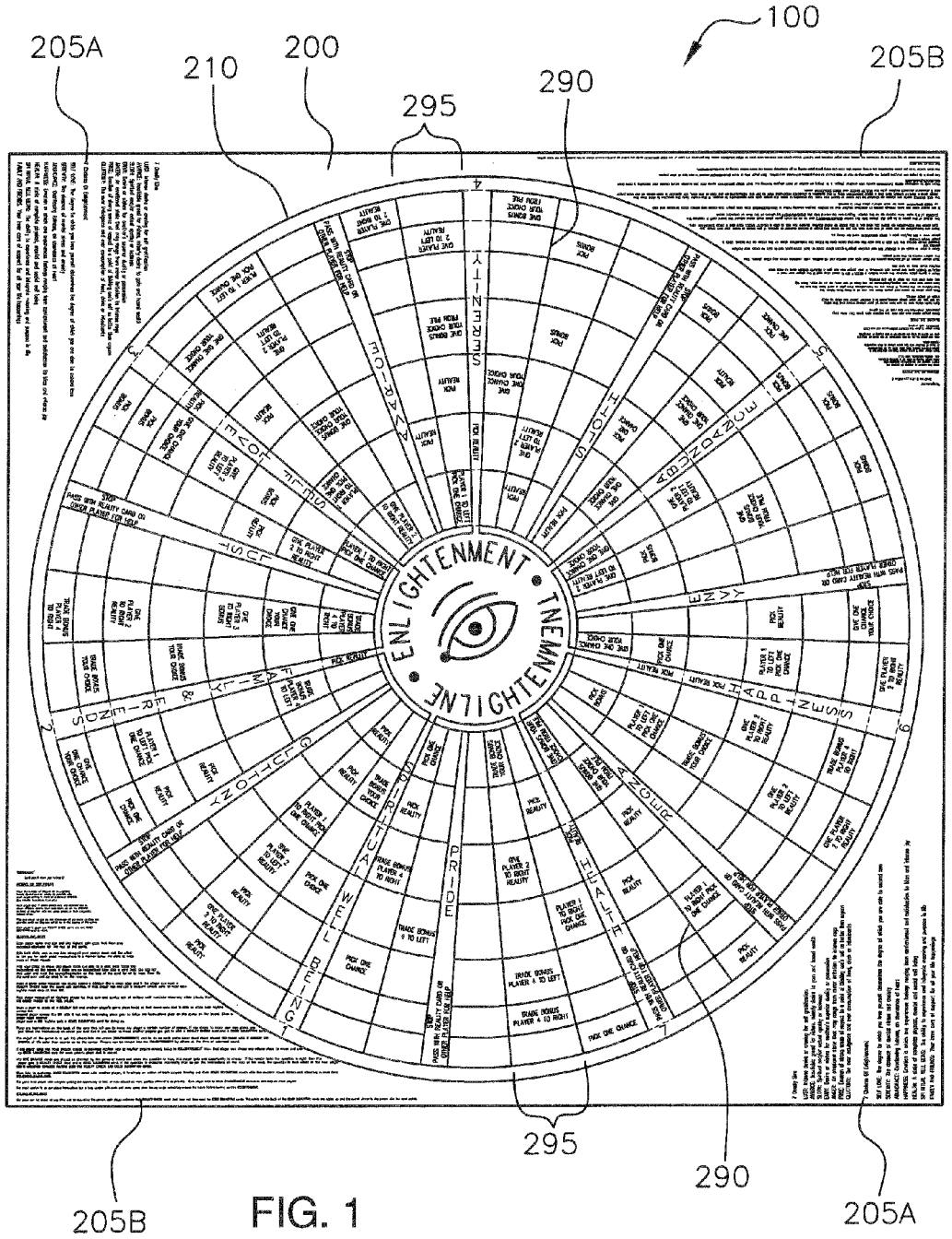
FIG. 1 is a top view of the board of the board game of the present invention.
Figure 2A:
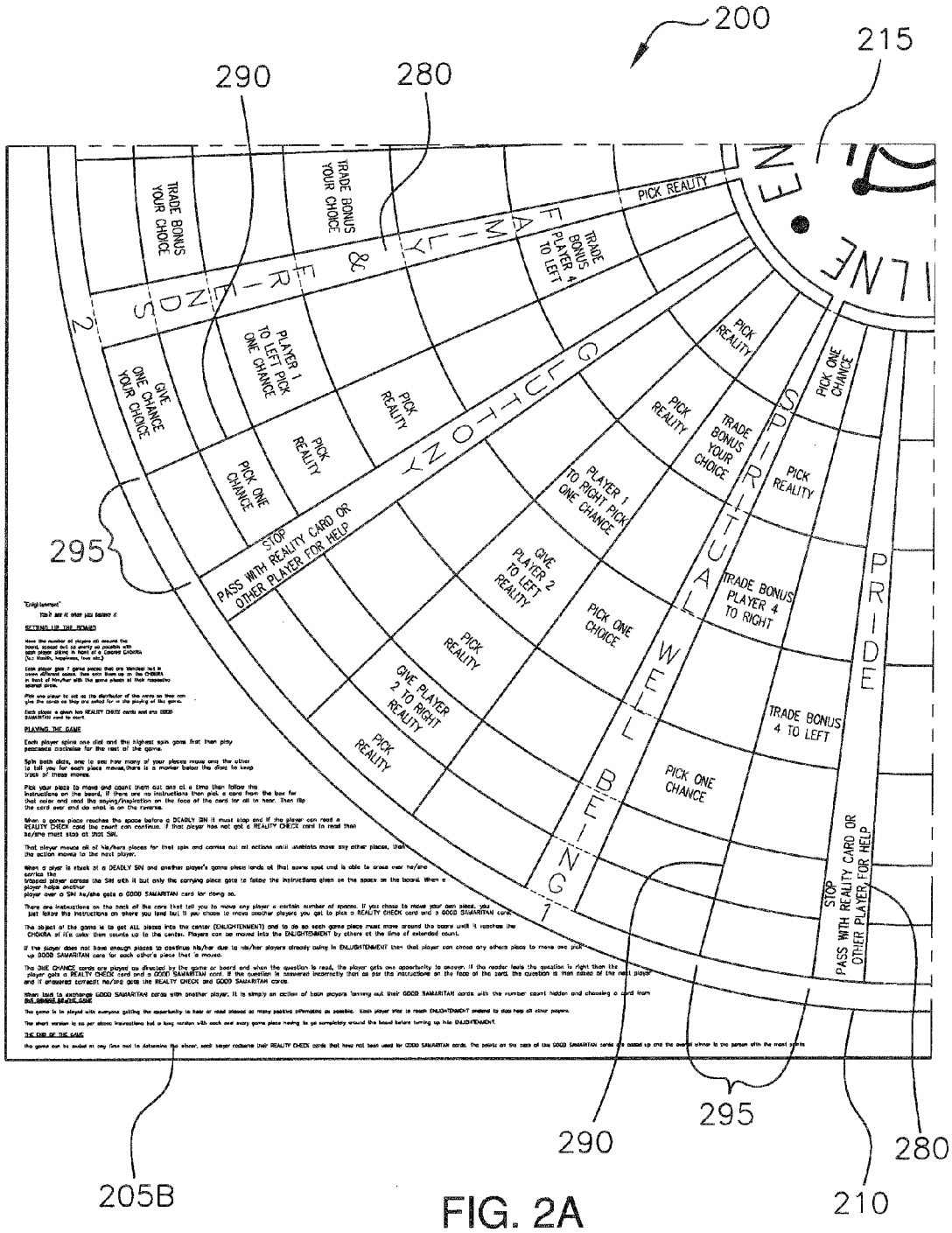
Figure 2B:
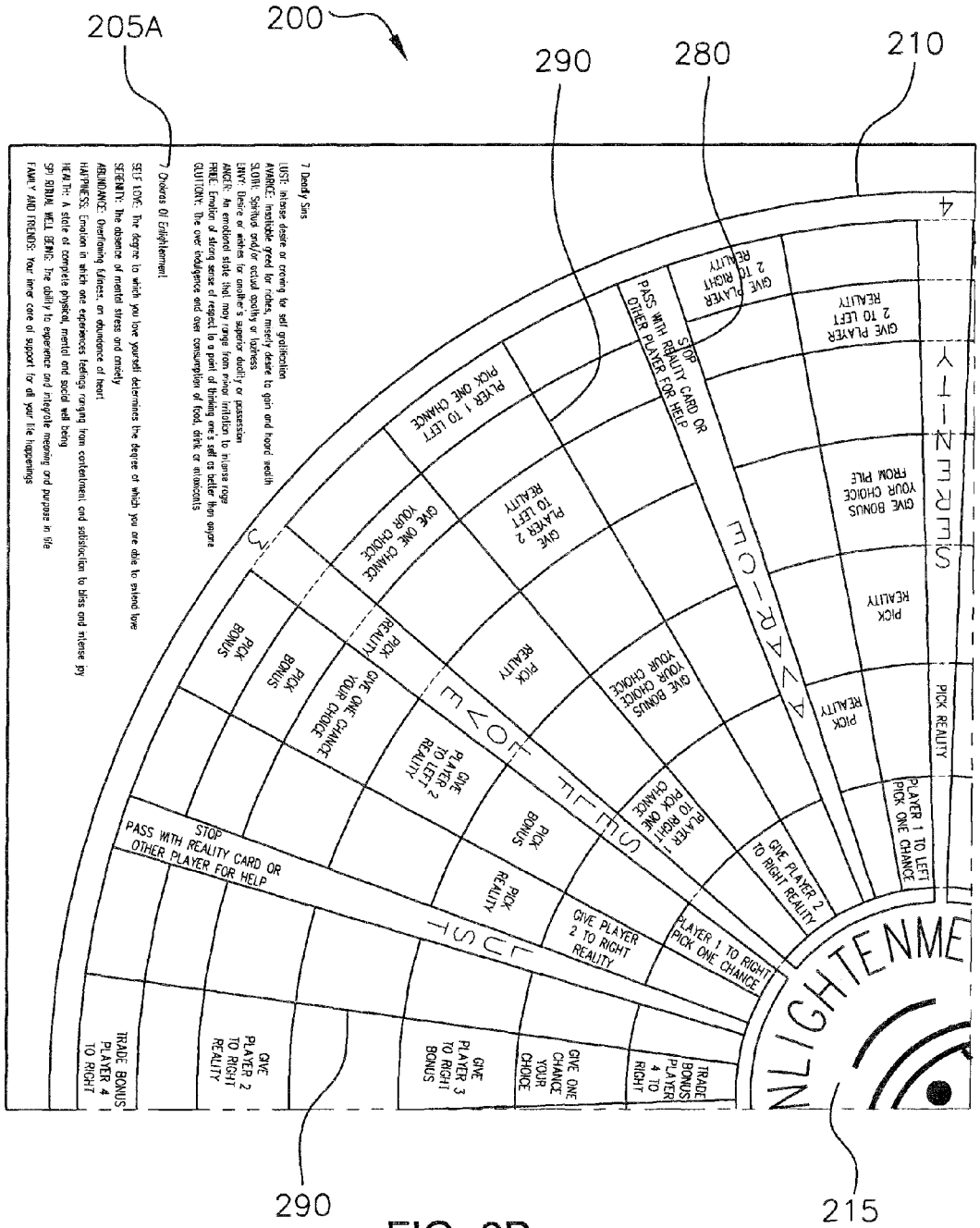
Figure 2C:
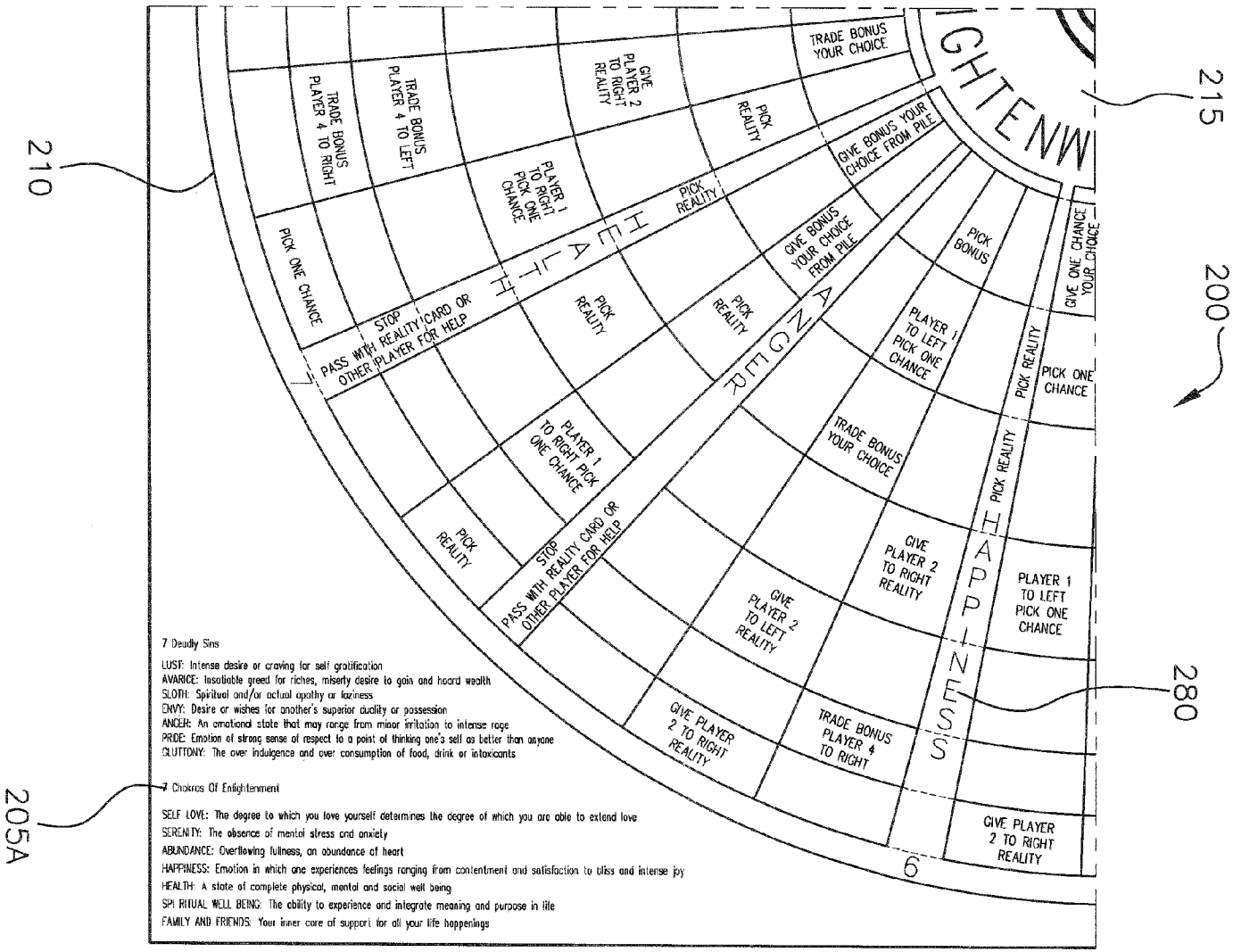
Figure 2E:
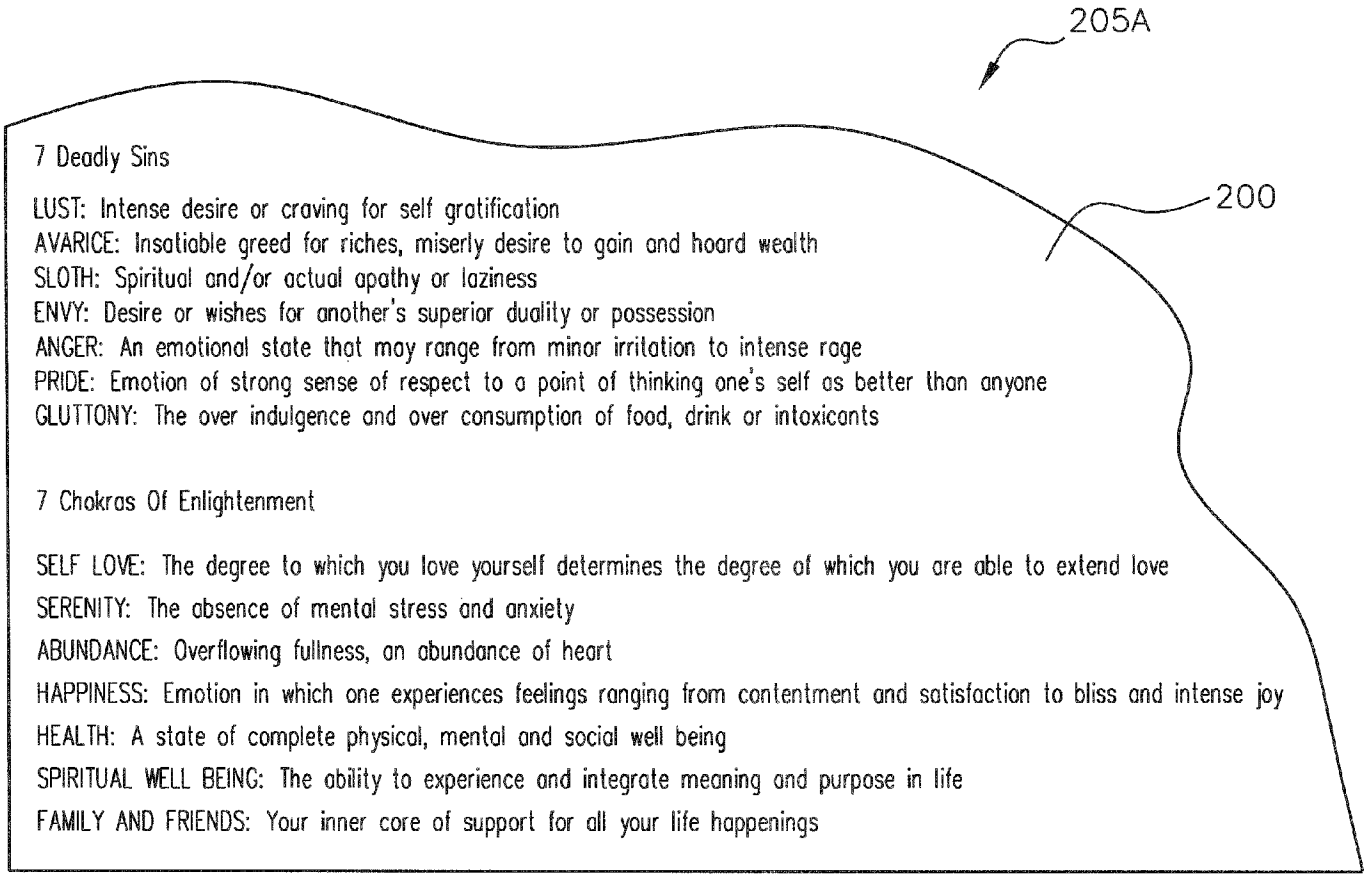

PRIDE: Emotion of strong sense of respect to a point of thinking one's self as better than anyone GLUTTONY: The over indulgence and over consumption of food, drink or intoxicants 7 Chokras of Enlightenment SELF LOVE: The degree to which you love yourself determines the degree of which you are able to extend love SERENITY: The absence of mental stress and anxiety ABUNDANCE: Overflowing fullness, an abundance of heart HAPPINESS: Emotion in which one experiences feelings ranging from contentment and satisfaction to bliss and intense joy HEALTH: A state of complete physical, mental and social well being SPIRITUAL WELL BEING: The ability to experience and integrate meaning and purpose in life FAMILY AND FRIENDS: Your inner core of support for all your life happenings FIGS. 2F-1 is a part of and precedes FIGS. 2F-2, where FIGS. 2-1 recites the following:

"Enlightenment"

You'll see it when you believe it

Setting Up the Board

Have the number of players sit around the board, spaced out as evenly as possible with each player sitting in front of a Colored CHOKRA (i.e.: Health, happiness, love etc)

Each player gets 7 game pieces that are identical but in seven different colors, then sets them up on the CHOKRA in front of him/her with the game pieces of their respective colored circle.

Pick one player to act as the distributor of the cards so they can give the cards as they are called for in the playing of the game.

Each player is given two REALITY CHECK cards and one GOOD SAMARITAN card to start.

Playing the Game

Each player spins one dial and the highest spin goes first then play proceeds clockwise for the rest of the game.

Spin both dials, one to see how many of your pieces move and the other to tell you far each piece moves, there is a marker below the dials to keep track of these moves.

Pick your piece to move and count them out one at a time then follow the instructions on the board, if there are no instructions then pick a card from the box for that color and read the saying/inspiration on the face of the card for all to hear. Then flip the card over and do what is on the reverse.

When a game piece reaches the space before a DEADLY SIN it must stop and if the player can read a REALITY CHECK card the count can continue. If that player has not got a REALITY CHECK card to read then he/she must stop at that SIN.

That player moves all of his/hers pieces for that spin and carries out all actions until unable to move any other pieces, then the action moves to the next player.

FIGS. 2F-2 is a part of and follows FIGS. 2F-1, where FIGS. 2F-2 recites the following:

When a player is stuck at a DEADLY SIN and another player's game piece lands at that same spot and is able to cross over he/she carries the trapped player across the SIN with it but only the carrying piece gets to follow the instructions given on the space on the board. When a player helps another player over a SIN he/she gets a GOOD SAMARITAN card for doing so.

There are instructions on the back of the cars that tell you to move any player a certain number of spaces. If you chose to move your own piece, you just follow the instructions on where you land but if you chose to move another players you get to pick a REALITY CHECK card and a GOOD SAMARITAN card.

The object of the game is to get ALL pieces into the center (ENLIGHTENMENT) and to do so each game piece must move around the board until it reaches the CHOKRA of it's color then counts up to the center. Players can be moved into the ENLIGHTENMENT by others at the time of extended count.

If the player does not have enough pieces to continue his/her due to his/her players already being in ENLIGHTENMENT then that player can chose any others piece to move and pick up GOOD SAMARITAN cars for each other's piece that is moved.

The ONE CHANCE cards are played as directed by the game or board and when the question is read, the player gets one opportunity to answer. If the reader feels the question is right then the player gets a REALTY CHECK card and a GOOD SAMARITAN card. If the question is answered incorrectly then as per the instructions on the face of the card, the question is then asked of the next player and if answered correctly he/she gets the REALTY CHECK and GOOD SAMARITAN cards.

When told to exchange GOOD SAMARITAN cards with another player, it is simply an action of both players fanning their GOOD SAMARITAN cards with the number count hidden and choosing a card from the others pile.

The Object of the Game

The game is to played with everyone getting the opportunity to hear or read allowed as many positive affirmations as possible. Each player tries to reach ENLGIHTENMENT and to also help all other players.

The short version is as per above instructions but a long version with each and every game piece having to go completely around the board before turning up into ENLIGHTENMENT The End of the Game The game can be ended at any time and to determine the winner, each player redeems their REALITY CHECK cards that have not been used for GOOD SAMARITAN cards. The points on the back of the GOOD SAMARITAN cards are added up and the overall winner is the person with the most points.

Figure 3:
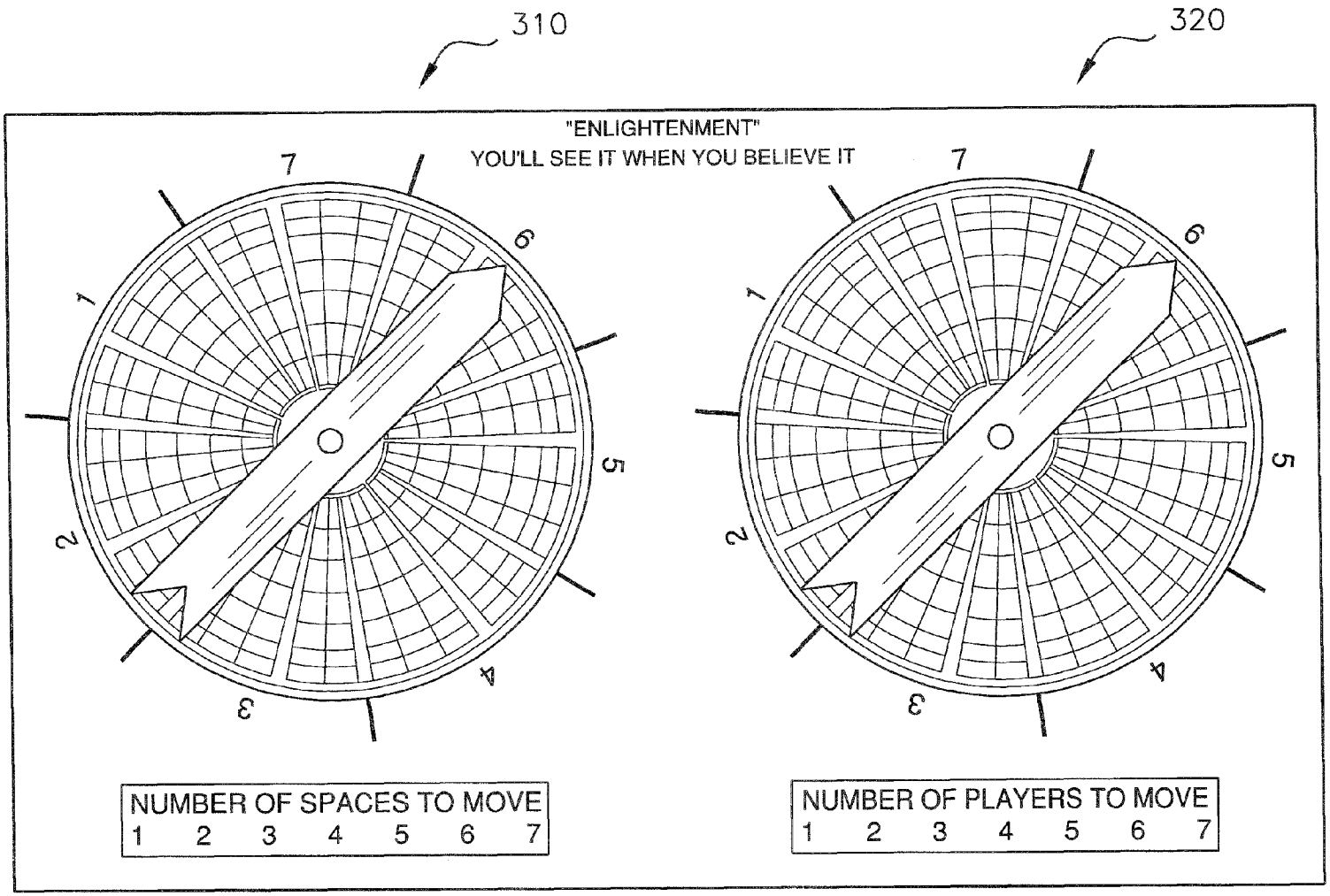

FIG. 3 is a top view of the wheels of the board game of the present invention.

Figure 4:
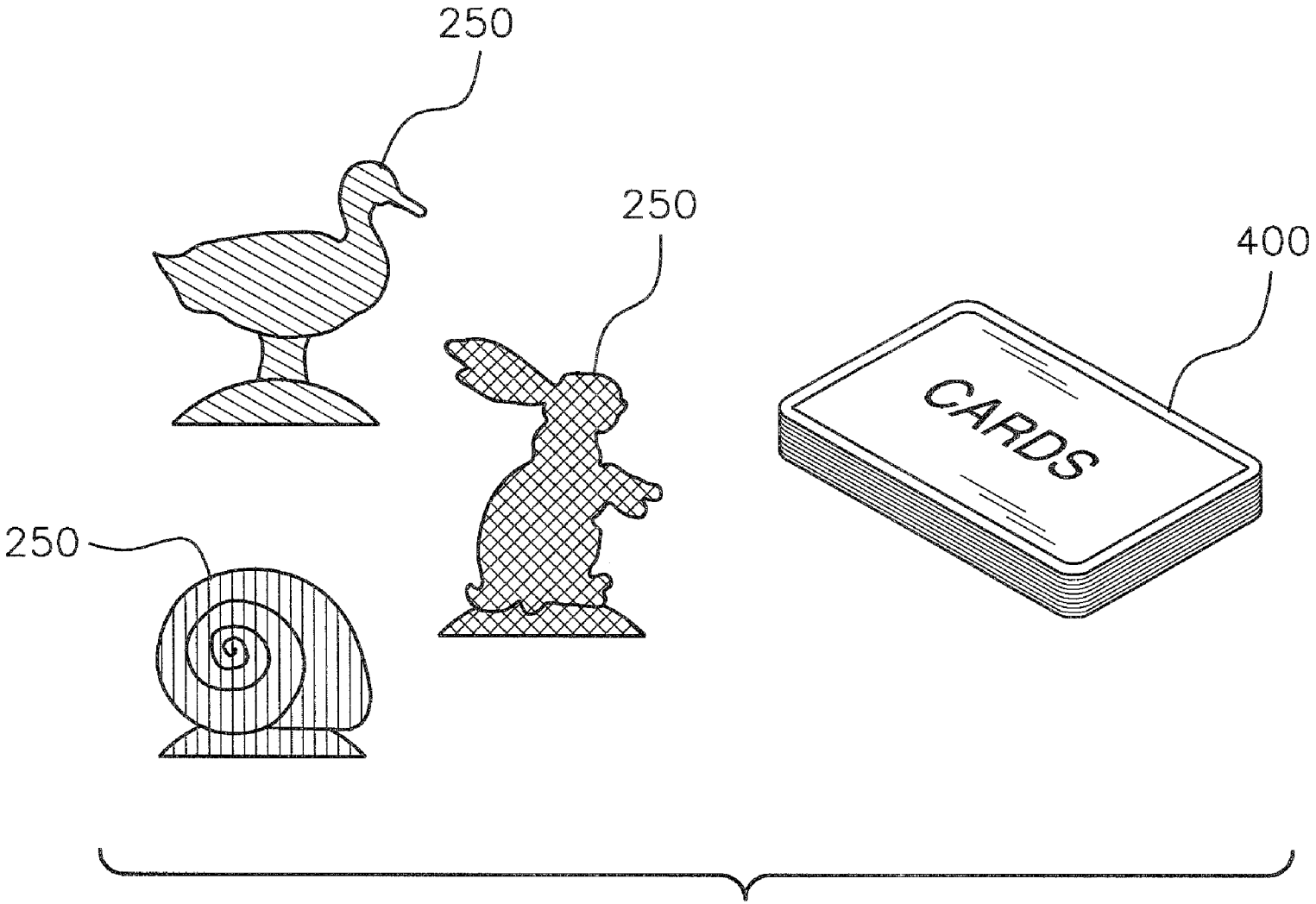

FIG. 4 is a front view of the playing pieces and cards of the board game of the present invention.

DESCRIPTION OF PREFERRED EMBODIMENTS

The following is a listing of numbers corresponding to a particular element refer to herein:

| | |
|---|---|
| 100 | board game |
| 200 | board |
| 205 | text |
| 210 | large circle |
| 215 | center circle |
| 250 | playing pieces |
| 280 | stripes |
| 290 | dividing lines |
| 295 | columns |
| 310 | first wheel |
| 320 | second wheel |
| 400 | cards |

Referring now to FIGS. 1-4, the present invention features a board game 100. The board game 100 may be an educational and entertaining game, and may incorporate spiritual learning as well. The object of the board game 100 of the present invention is to move all of one's playing pieces 250 into the center circle 215 of the board 200. To move one's pieces 250 into the center circle 215 of the board 200, a player must help other players.

Board and Playing Pieces

The board 200 is a generally flat panel having a decorated top surface and four corners. In some embodiments, text 205 is written on the board 200. As shown in FIG. 1, FIG. 2B, FIG. 2C, and FIG. 2E, text 205 may include "7 DEADLY SINS: LUST, AVARICE, SLOTH, ENVY, ANGER, PRIDE, GLUTTONY." Text may include "7 CHAKRAS OF ENLIGHTENMENT: SELF LOVE, SERENITY, ABUNDANCE, HAPPINESS, HEALTH, SPIRITUAL WELL BEING, FAMILY AND FRIENDS." In some embodiments, text 205 is written in one or more corners of the board 200. In some embodiments, text 205 includes the rules of the game. Disposed in the center of the board 200 is a large circle 210. Evenly spaced along the outer edge of the large circle 201 are the seat numbers 1, 2, 3, 4, 5, 6, and 7. The large circle 210 has a center circle 215. Extending radially from the center circle 215 to the large circle 210 are fourteen stripes 280. The stripes 280 are generally although not completely evenly spaced apart. The stripes 280 are each labeled. Labels include Envy, Abundance, Sloth, Serenity, Avarice, Self Love, Lust, Family and Friends, Gluttony, Spiritual Well Being, Pride, Health, Anger, and Happiness. These labels represent the 7 deadly sins and the 7 chakras of enlightenment in an alternating pattern.

In addition to the fourteen stripes 280, twenty one dividing lines 290 extend radially from the center circle 215 to the outer circle 210. The dividing lines 290 are generally although not completely evenly spaced apart. For example, there are two dividing lines 290 in between the stripes 280 labeled "Anger" and "Happiness" and there is one dividing line 290 in between the stripes 280 labeled "Happiness" and "Envy.:" The stripes 280 in combination with the dividing lines 290 create 35 separate columns 295.

Extending outwardly from the center circle 215 toward the large circle 210 are 7 concentric circles. The concentric circles each cross over the fourteen stripes. The intersections of the concentric circles with the stripes 280 and dividing lines 290 create boxes. For example, there are 21 boxes between the stripes 280 labeled "Envy" and "Abundance."

In some embodiments, one or more boxes are labeled with commands. Commands may include Pick Bonus, Pick One Chance, Give Bonus Your Choice From Pile, Give Player 2 To Left Reality, Give One Chance Your Choice, Player 1 To Left Pick One Chance, Trade Bonus Your Choice, Give Player 2 To Right Reality, Trade Bonus Player 4 To Right, or the like. The commands tell a player what to do if he/she lands on the box.

As shown in FIG. 3, the board game 100 further comprises a first wheel 310 and a second wheel 320. Such wheels are well known to one of ordinary skill in the art. The wheels 310 have an arrow that spins freely about an axis. The arrow has a pointed end. A player can spin the arrow about the wheel 310. When the arrow stops, the player reads the result of his/her spin by viewing the pointed end of the arrow. The first wheel 310 determines how many spaces a player can move. The second wheel 320 determines how many playing pieces 250 a player can move. The player spins both wheels during his/her turn. The first wheel 310 is divided evenly into 7 sections, each section labeled with a number 1 through 7. The second wheel 320 is divided into seven sections, each section labeled with a number 1 through 7.

The board game 100 of the present invention includes a plurality of playing pieces 150. In some embodiments, the playing pieces 250 resemble animals such as rabbits, ducks, snails, or other animal (see FIG. 4).

The board game 100 of the present invention further comprises a plurality of cards 400. There may be up to 1500 cards 400. The cards 400 may display instructions or phrases. Cards 400 include "Reality Check" cards, "Good Samaritan" cards, and the like.

In some embodiments, the board 200 is decorated with a variety of colors.

Playing the Board Game

To play, two to seven players sit around the board 200 at each of the 7 seat numbers. Each player receives seven playing pieces 250 and lines each playing piece 250 along the stripe 280 at his seat number. The seven playing pieces 250 travel around the board in between the concentric circles. For example, a player sitting at seat number 6 places one playing piece 250 on the stripe 280 labeled "Happiness" in between the center circle 215 and the first concentric circle from the center circle 215. He places another playing piece 250 in between the next concentric circle, and so on.

In some embodiments, the colors of the playing pieces 250 match the color of the players seat number. For example, the stripes 280 for the chakras may each have a different color, and playing pieces 250 are divided up according to those colors.

A player is chosen to be the distributor of the cards 400. Each player is given two "Reality Check" cards and one "Good Samaritan" card. A first player is chosen. The first player may be chosen by spinning the wheels. The player to spin the highest number starts first.

The first player spins both the first wheel 310 and the second wheel 320. When the player moves a playing piece 250, the player follows the instructions in the box where the playing pieces 250 lands. If there are no instructions in the box, then the player draws a card 400 with the color that corresponds to the color of the box where he/she landed and reads the phrases on the card for all players to hear. The player then flips the card over and does what the instructions instruct him/her to do.

Players attempt to move each playing piece 250 around the board and get each playing piece over each of the stripes 280 labeled with the seven deadly sins. If a playing piece lands on a stripe 280 with one of the seven deadly sins, the playing piece stops there. The player must play a "Reality Check" card before he/she can move the playing piece beyond that stripe 280. If the player cannot play a "Reality Check" card, the playing piece 250 cannot move. The player's turn continues until he/she has moved all possible playing pieces 250. After the first player has completed his/her turn, the player clockwise to him/her begins his/her turn.

If a player is able to cross a Deadly Sin stripe 280 and an opponent's piece is located on that deadly sin stripe 280, the player can carry the opponent's piece over the deadly sin strip 280 and receive a "Good Samaritan" card for doing so.

After a playing piece 250 has passed over all seven deadly sin stripes 280, the playing piece 250 moves to the center circle 215 labeled "Enlightenment." When all of the players have all of their respective playing piece 250 in the center circle 215, each player exchanges all of his unused "Reality Check" cards for "Good Samaritan" cards. The "Good Samaritan" cards are worth varying points. All players tally up their points. The player with the most points wins.

The following the disclosures of the following U.S. Patents are incorporated in their entirety by reference herein: U.S. Pat. No. 5,071,133; U.S. Pat. No. 5,092,606; U.S. Pat. No. 5,152,535; U.S. Pat. No. 5,295,834; U.S. Pat. No. 5,529,308; U.S. Pat. No. 5,377,991.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A board game for between two and seven players, said board game comprising:

(a) a board comprising (i) a large outer circle disposed thereon, wherein numbers 1, 2, 3, 4, 5, 6, and 7 are written evenly spaced along an outer edge of the large outer circle;

(ii) a center circle disposed in the large circle;

(iii) fourteen stripes each extending radially from the center circle to the large outer circle, each stripe having a label, the labels alternating between a deadly sin and a chakra of enlightenment;

(iv) twenty one dividing lines extending radially from the center circle to the large outer circle, wherein the stripes in combination with the dividing lines create separate columns; and (v) seven concentric circles extending outwardly from the center circle to the large outer circle, wherein the concentric circle, stripes, and dividing lines create boxes; wherein a plurality of boxes are labeled with a command; wherein the command is selected from the group consisting of Pick Bonus, Pick One Chance, Give Bonus Your Choice From Pile, Give Player 2 To Left Reality, Give One Chance Your Choice, Player 1 To Left Pick One Chance, Trade Bonus Your Choice, Give Player 2 To Right Reality, and Trade Bonus Player 4 To Right;

(b) a plurality of playing pieces;

(c) a first wheel for determining how many boxes a player can move a playing piece;

(d) a second wheel for determining how many playing pieces a player can move; and (d) a plurality of cards that display a phrase and a plurality of "Reality Check" cards and "Good Samaritan" cards.

2. The board game of claim 1, wherein the deadly sin is selected from the group consisting of Envy, Sloth, Avarice, Lust, Gluttony, Pride, and Anger.

3. The board game of claim 1, wherein the chakra of enlightenment is selected from the group consisting of Abundance, Serenity, Self Love, Family and Friends, Spiritual Well Being, Health, and Happiness.

4. The board game of claim 1, wherein the playing pieces resemble animals.

* * * * *